US005460546A

United States Patent [19]

Kunishi et al.

[11] Patent Number: 5,460,546

[45] Date of Patent: Oct. 24, 1995

[54] ELECTRIC CONNECTOR TERMINAL AND METHOD OF MARKING THE SAME

[75] Inventors: Shinsuke Kunishi, Osaka; Mitsuo Fujikura, Zama, both of Japan

[73] Assignee: Molex Incorporated, Lisle, Ill.

[21] Appl. No.: 201,291

[22] Filed: Feb. 24, 1994

[30] Foreign Application Priority Data

Mar. 8, 1993 [JP] Japan ..... 5-072977

[51] Int. Cl.[6] ..... H01R 23/70

[52] U.S. Cl. ..... 439/631; 439/62

[58] Field of Search ..... 439/630–637, 439/326–328, 62, 65, 651, 654

[56] References Cited

U.S. PATENT DOCUMENTS

| | | | |
|---|---|---|---|
| 3,307,139 | 2/1967 | Prise | 459/631 |
| 4,383,724 | 5/1983 | Verhoeven | 339/19 |
| 4,385,795 | 5/1983 | Endoh et al. | 339/176 |
| 4,392,702 | 7/1983 | Walkup | 339/19 |
| 4,482,198 | 11/1984 | Crowley | 339/19 |
| 4,516,817 | 5/1985 | Deters | 339/19 |
| 4,637,677 | 1/1987 | Barkus | 339/274 |
| 4,747,790 | 5/1988 | Masuda et al. | 439/631 |
| 4,824,395 | 4/1989 | Blaha | 439/438 |
| 4,946,403 | 8/1990 | Billman et al. | 439/631 |
| 5,116,238 | 5/1992 | Holloman | 439/441 |
| 5,149,279 | 9/1992 | Kruse | 439/441 |
| 5,158,475 | 10/1992 | Tyler | 439/439 |

FOREIGN PATENT DOCUMENTS 1480097 5/1967 France .

*Primary Examiner*—David L. Pirlot
*Attorney, Agent, or Firm*—Stephen Z. Weiss

[57] ABSTRACT

Disclosed is an improved electric connector having terminals for contacting two circuit elements (34 and 35). Each terminal includes a flat intermediate base mounting section (2) having projections (7) on its opposite sides, a first cantilever contact beam (3) integrally connected to one end of the intermediate base section (2) extending toward the other end of the intermediate base section (2), and a second cantilever contact beam (4) integrally connected to the other end of the intermediate base section (2) extending toward the one end of the intermediate base section (2). The first contact beam (3) has a contact point (8) resiliently pushed against the upper guide wall (23). This will insure that the conductor (35) is sandwiched between the upper guide wall (23) and the contact point (8) making a good electrical connection. Likewise, the second contact beam (4) has a contact point (10) resiliently pushed against the upper wall (24). This will insure that the conductor (34) is sandwiched between the lower guide wall (24) and the contact point (10) making a good electrical connection.

5 Claims, 6 Drawing Sheets

ELECTRIC CONNECTOR TERMINAL AND METHOD OF MARKING THE SAME

FIELD OF THE INVENTION

The present invention relates to an improved electric connector having an improved S-shaped terminal allowing for the interconnection of a group of first circuit elements with a group of second circuit elements. Where both groups of elements enter the connector housing from the same side.

BACKGROUND OF THE INVENTION

In the past, one conductor from a flat flexible cable (FFC) or first circuit element has been connected to another conductor such as a terminal lead from a florescent lamp or a second circuit element. The FFC conductor was connected to a selected conductor on a printed circuit board via an associated electric connector, and the selected conductor in the printed circuit board was connected to a terminal lead from the fluorescent lamp via another associated electric connector. Thus, one conductor is connected to the other conductor via a selected conductor in an associated printed circuit board, and accordingly since the two associated connectors must be affixed to the printed circuit board an additional amount of space is required for this electric connection.

In an attempt to reduce the use of additional space on the printed circuit board, a single electric connector has been used to make a direct connection between the circuit elements without the connector being affixed to a printed circuit board. French Patent No. 1,480,097 discloses an "S"-shaped electric connector terminal which comprises a flat intermediate base section, a first contact beam integrally connected to and bent from one end of the intermediate base section, and a second contact beam integrally connected to and bent from the other end of the intermediate base section. These first and second beams are biased inwardly so that their contact portions achieve contact with the flat intermediate base section, thereby permitting each contact section and flat intermediate base section to sandwich one of the circuit elements respectively therebetween.

This conventional "S"-shaped electric connector terminal permits two conductors or circuit elements to be electrically connected without the use of two connectors affixed to a printed circuit board. However there are some disadvantages.

The first disadvantage is that two conductors or circuit elements must be inserted into opposite ends of the housing in opposite directions. Therefore, insertion and connection of two conductors or circuit elements in the same direction was not possible.

The second disadvantage is that the first contact beam has its free end inclined upwardly toward one terminal insertion cavity wall and the second contact beam has its free end inclined downwardly toward a second terminal insertion cavity wall. Because the free end of both beams are both bent so that they are directed outwardly toward the terminal insertion cavity walls, the free ends may be caught by the opening in the terminal insertion cavity. Therefore, automatic loading of these terminals in the terminal insertion cavities is not appropriate. Also with the prior art connectors, the terminals were formed with the same type of contact portions as, for example, both contact portions being a generally non-disengagable wire trap or both being a disengagable contact.

SUMMARY OF THE INVENTION

One object of the present invention is to provide electric connector having terminals which permit insertion of two circuit elements in the same direction and from the same side of the connector housing.

Another object of the present invention is to provide electric connector terminals which permit automatic insertion into respective terminal insertion cavities in the housing without being caught by the front face of the terminal insertion cavity.

Still another object of the present invention is to provide an electric terminal having two contact portions one general non-disengagable with one circuit element and the other disengagable with another circuit element.

To attain these and other objects an electric connector for connecting a first circuit element with a second circuit element is provided including, a housing having a mounting end, a mating end and first and second contact beam receiving cavities. A generally S-shaped terminal is mounted in the housing. The terminal has first and second cantilever beams disposed in the first and second cavities, respectively, with an intermediate base mounting section between the contact beams. The first and second cavities have respective openings at the mating end of the housing for receiving the first and second circuit elements, respectively, from the same end of the housing. The first cantilever contact beam in the first cavity extends toward the respective opening to a free and of the beam and is adapted to apply a relative minimum withdrawal force on the first circuit element. The second cantilever contact beam in the second cavity extends away from the respective opening to a free end of the beam and is adapted to apply a relative maximum withdrawal force on the second circuit element.

BRIEF DESCRIPTION OF THE DRAWINGS

Other objects and advantages of the present invention will be understood from the following description of preferred embodiments of the present invention, which are shown in the accompanying drawings.

DETAILED DESCRIPTION OF THE PREFERRED EMBODIMENT

Figure 1:
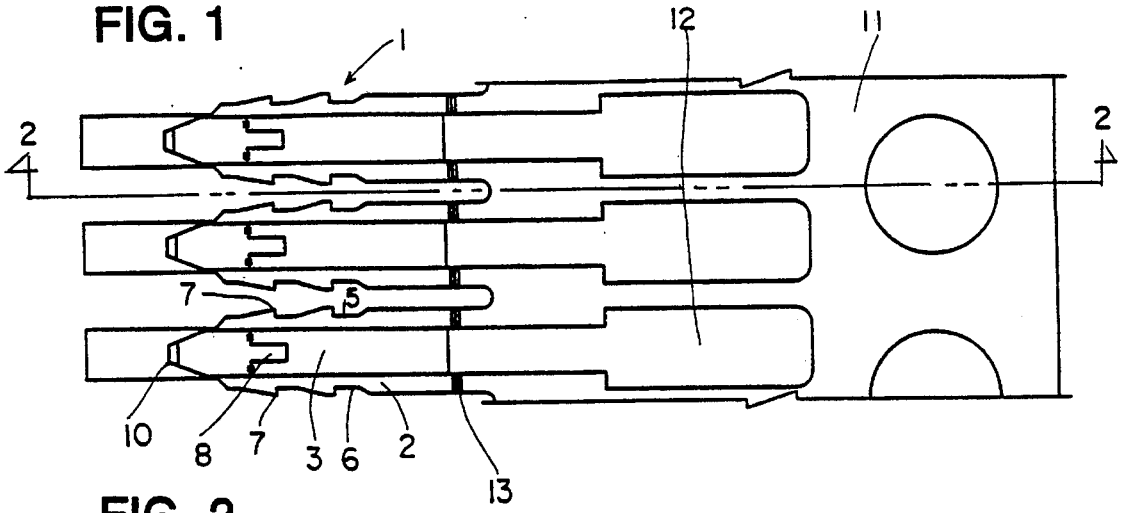
FIG. 1 is a plane view of a parallel arrangement of terminals integrally connected to a carrier strip.

Referring to FIGS. 1 through 6 and 13, a terminal 1 comprises a flat intermediate base mounting section 2 having projections 7 on its opposite sides. A first cantilever contact beam 3 is integrally connected to one end of the intermediate base section 2 and bent to extend toward the other end of the intermediate base section 2, ending with a free end 10 bent toward the base terminal. A second cantilever contact beam 4 is integrally connected to the other end of the intermediate base section 2 and bent to extend toward the one end of the intermediate base section 2 with the second free end directed away from the base section 2. As seen from FIG. 2, the first contact beam 3 is bent in the form of a "U" on one side of the terminal whereas the second contact beam 4 is bent in the form of a "U" on the other side of the terminal. Thus, these contact beams 3 and 4 form the shape of the letter "S".

Figure 2:
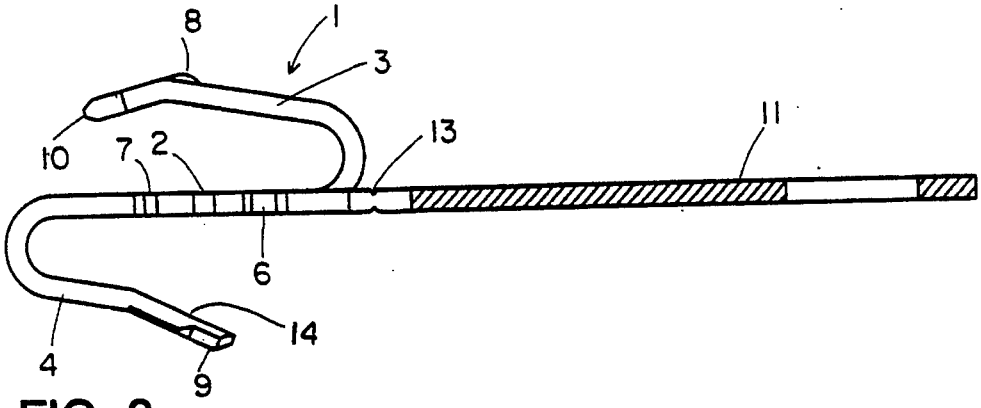
FIG. 2 is a cross section taken along line 2—2 in FIG. 1.
Figure 3:
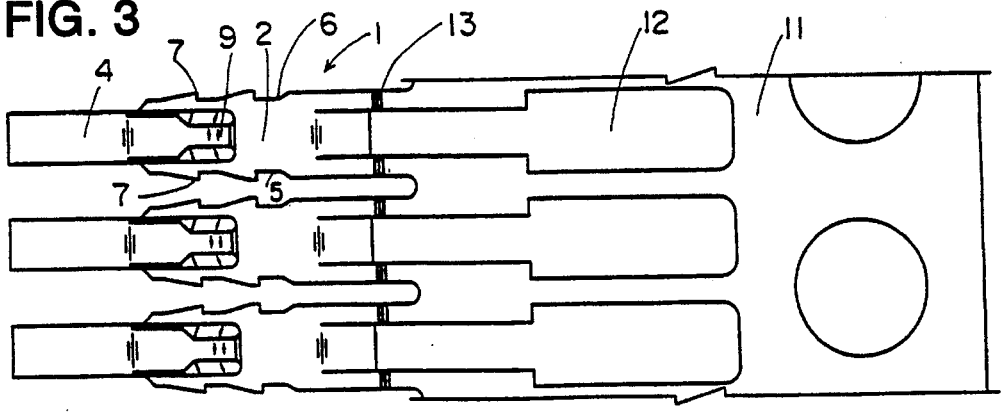
FIG. 3 is a bottom view of the parallel arrangement of terminal of FIG. 1.
Figure 4:
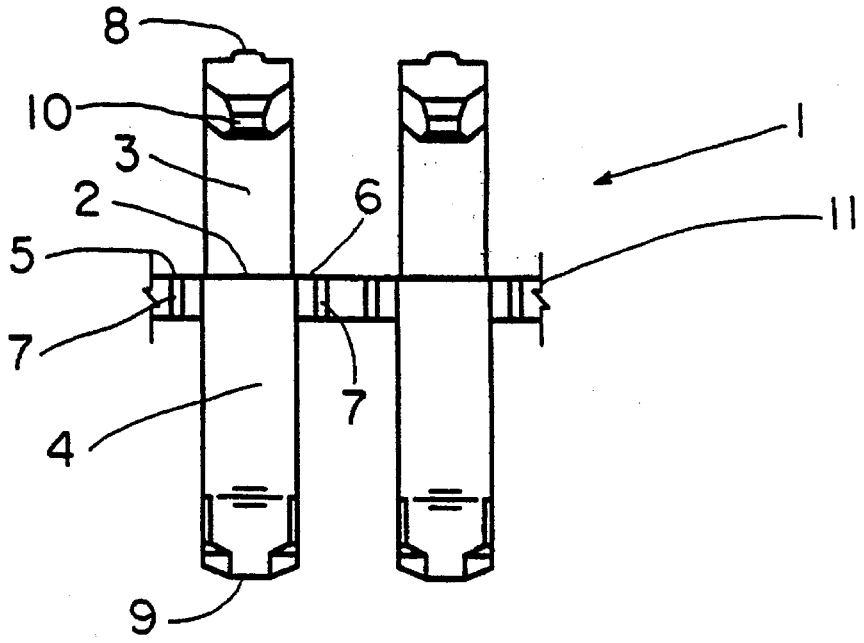
FIG. 4 is a front view of a fragment of parallel arrangement of terminals of FIG. 1.
Figure 5:
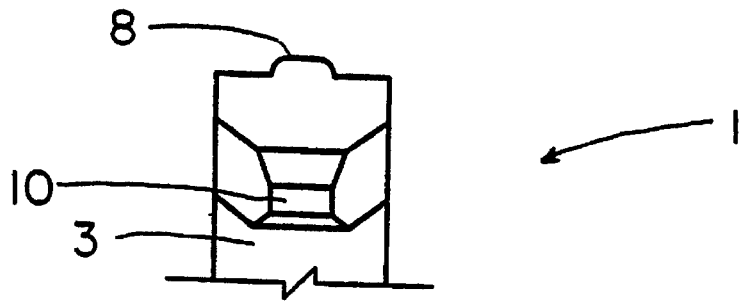
FIG. 5 is an enlarged front view of the contact of a first contact beam.
Figure 6:
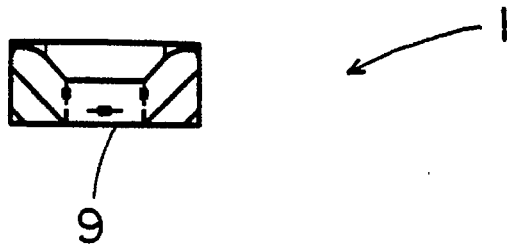
FIG. 6 is an enlarged rear view of the contact of a second contact beam.
Figure 7:
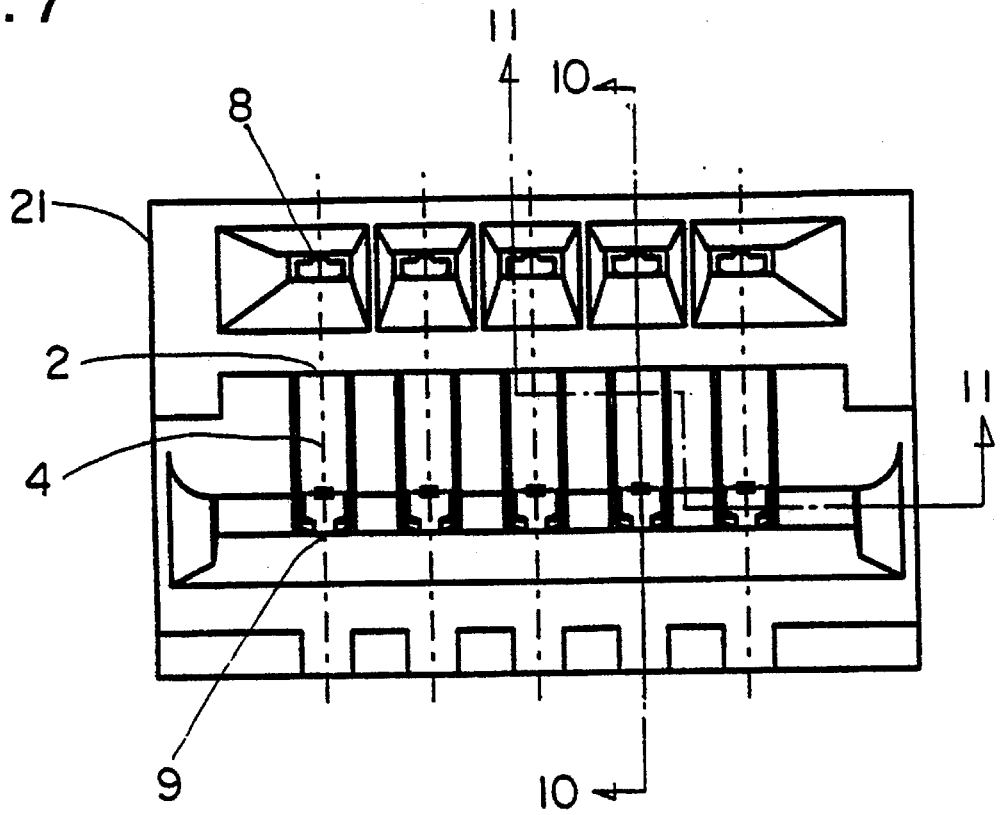
FIG. 7 is a front view of an electric connector receptacle.
Figure 8:
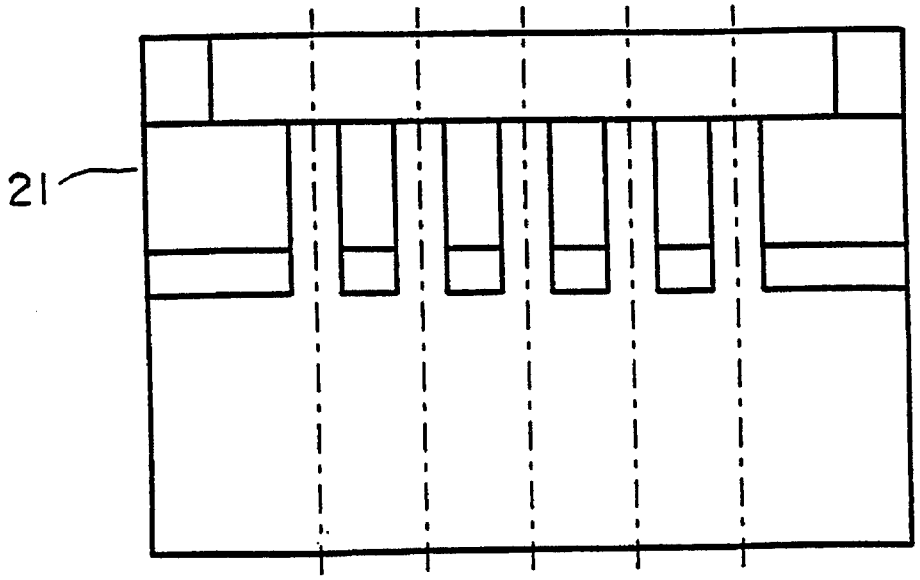
FIG. 8 is a bottom view of the electric connector receptacle of FIG. 7.
Figure 9:
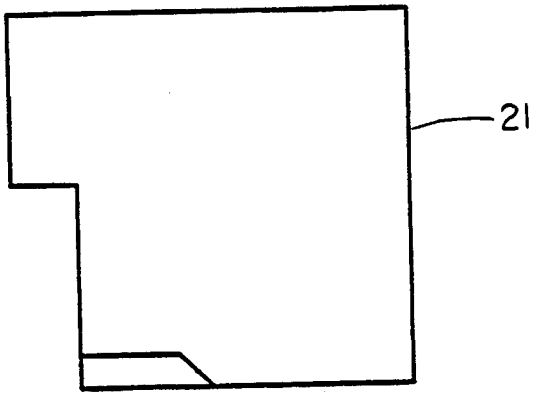
FIG. 9 is a right side view of the electric connector receptacle of FIG. 7.

As best seen from FIG. 2, the first contact beam 3 has a rounded contact point 8 at the crest of the first free end 10 for engaging the first circuit element 35 and adapted to apply a relative minimum withdrawal force on the first circuit element 35. The second contact beam 4 has a contact point 9 at the tip of its free end 14 forming a generally non-disengagable wire trap which is adapted to apply a relative maximum withdrawal force on the second circuit element 34. These contact points 8 and 9 face the upper and lower guide walls 23, 24 of associated contact beam cavities of the terminal receiving cavities 30 as will be described later in more detail.

These terminals 1 are manufactured by first stamping out from sheet metal a plurality of elongated pieces whose ends are integrally connected to a carrier strip 11. The first contact beam 3 of each elongated piece is bent so as to extend toward the other end of the intermediate base section 2. Next the second contact beam 4 of each elongated piece is bent so as to extend toward the one end of the intermediate base section 2. More specifically, the rectangular section 12 of every first contact beam 3 is raised from the carrier strip 11, and bent toward the other end of the intermediate base section. All elongated pieces thus bent are inserted in the contact beam cavity of the receptacle housing, and the carrier strip 11 is cut at line 13 and removed. FIG. 7 through 11 show an electric connector receptacle having a plurality of terminals 1 inserted therein.

Figure 10:
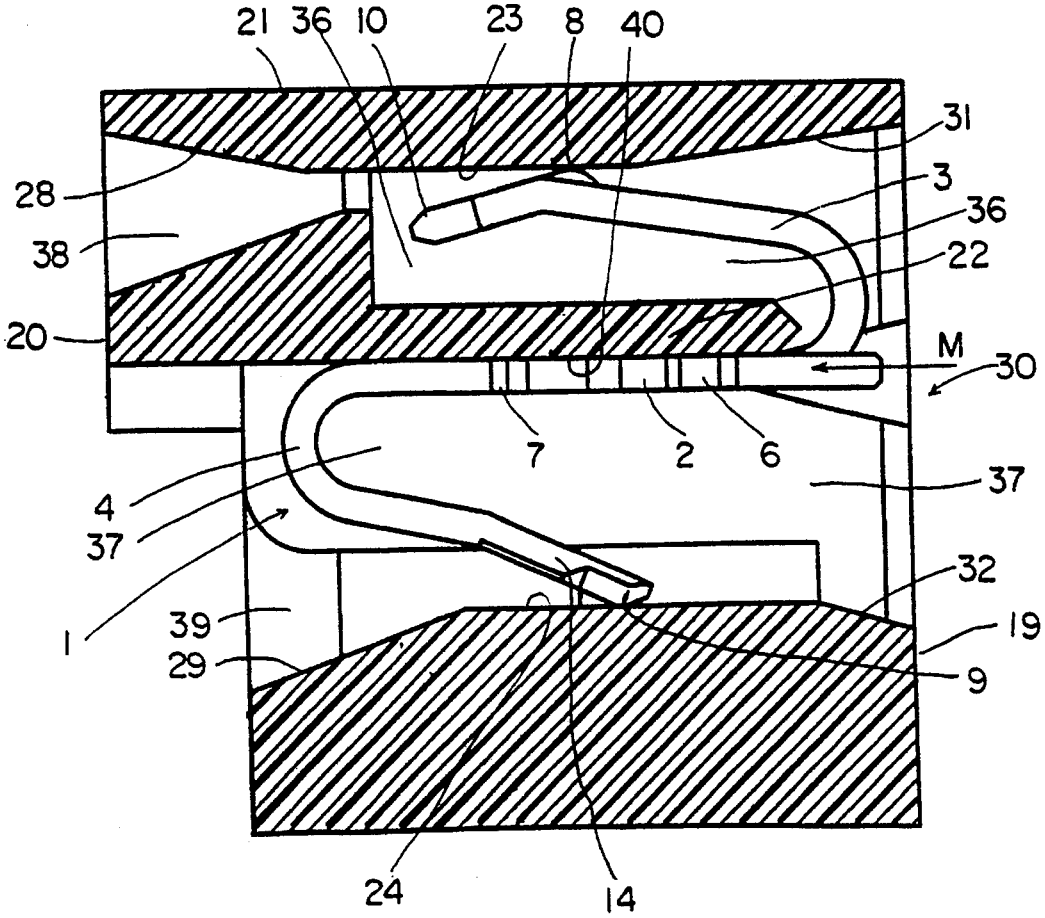
FIG. 10 is a cross section taken along the line 10—10 in FIG. 7.
Figure 11:
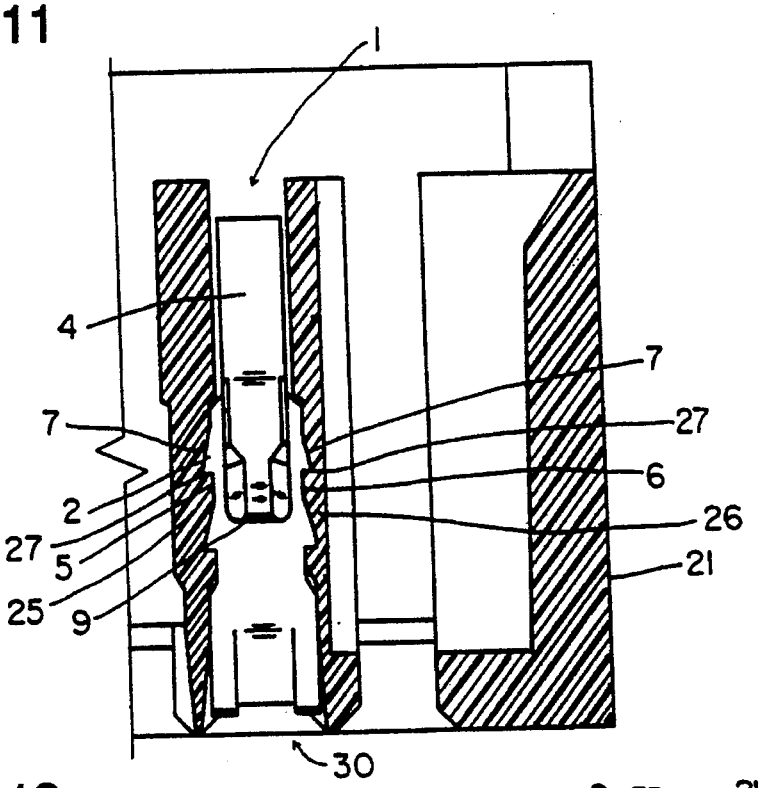
FIG. 11 is a section taken along the line 11—11 in FIG. 7.

As shown in FIG. 10, the receptacle housing 21 has an intermediate wall 22 and a series of upper and lower contact beam cavities 36 and 37 arranged on opposite sides of the intermediate wall 22. Each upper contact beam cavity 36 is defined by a ceiling or upper wall 23, an upper surface of the intermediate wall 22, and opposite partition walls 25 and 26. Likewise, each lower contact beam cavity 37 is defined by a floor or lower wall 24, a lower surface 40 of the intermediate wall 22, and opposite partition walls 25 and 26. The intermediate base mounting section 2 has lateral projections 7 on opposite sides adapted to skive into the opposite partition walls and a surface adapted to lay on the lower surface 40 of the intermediate wall whereby the terminal is held in the housing.

The upper circuit element insertion opening 38 in the housing mating end 20 is delimited by an inwardly converging wall 28, and communicates with the upper contact beam cavity 36 which has an inwardly converging wall 31. Likewise, the lower circuit element insertion opening 39 in the housing mating end 20 delimited by an inwardly converging wall 29, communicates with the lower contact beam cavity 37 which has an inwardly converging wall 32. The terminal receiving cavities 30 communicates with and includes upper and lower contact beam cavities 36 and 37.

Terminals 1, integrally connected to the carrier strip 11, are inserted into the mounting end 19 of the housing 21. The first cantilever contact beams 3 are directed into the upper contact beam cavities 36 and the second cantilever contact beams 4 are directed to the lower contact beam cavities 37. Thereafter, the terminal is pushed into the terminal receiving cavity 30 in the direction of M in FIG. 10, allowing the intermediate base sections 2 of the terminals 1 to slide along the lower surfaces 40 of the intermediate wall 22 of the housing 21, whereby projections 7 of the intermediate base sections 2 are caught by the opposite partitions 25 and 26, as indicated at 27 in FIG. 11. The first cantilever contact beams 3 are yieldingly bent and pushed against the ceilings 23 with their free ends 10 bent toward the base section 2. This will result in the circuit element 35, inserted into the upper circuit element insertion opening 38, being forced against ceiling 23 by contact point 8 on the first contact beams 3. Likewise, the second contact beams 4 are yieldingly bent and pushed against the floors 24. This will result in the circuit element 34, inserted into the lower circuit element insertion opening 39, being forced against floors 24 by contact point 9 on the second contact beams 4.

Each contact beam 3 and 4 is integrally connected to the intermediate base section 2 which is fixed to the rigid intermediate wall 22 by projections 7. Each contact beam 3 and 4 is located in an associated contact beam cavities 36 and 37 respectively. Therefore, both contact beams are held steadily so as to permit application of an appropriate contact force upon one or both circuit elements, which are inserted through the circuit element insertion openings 38 and 39 into the respective contact beam cavities 36 and 37 and into contact with contact point 8 and 9.

The first free end 10 of the first cantilever contact beam 3 is adapted to be inserted into the center of the upper contact beam cavities 36 during insertion. The contact point 9 of the free end 14 of the second cantilever contact beam 4 is adapted to slide along floor 24 during insertion. These relationships assure that the terminal 1 can be inserted into the terminal receiving cavities without fear of being caught and damaged.

Figure 12:
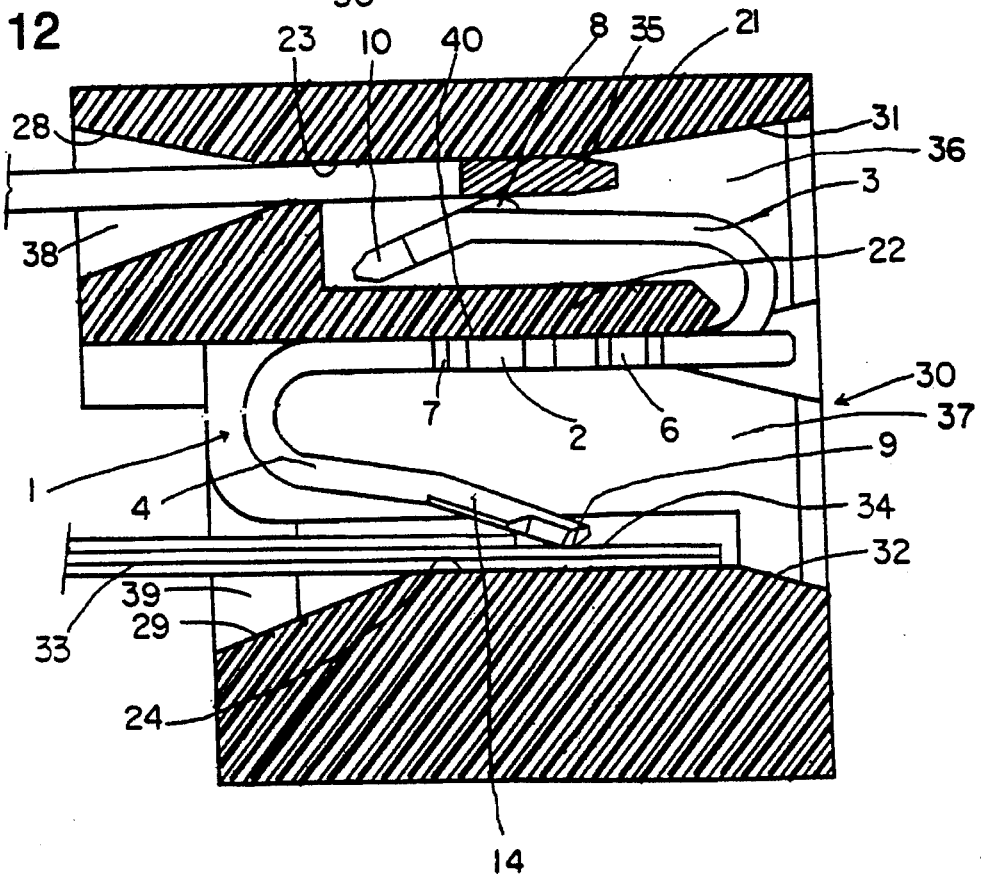
FIG. 12 is a cross section similar to FIG. 10, but showing the electric connector receptacle having an FFC and a pin terminal inserted therein.
Figure 13:
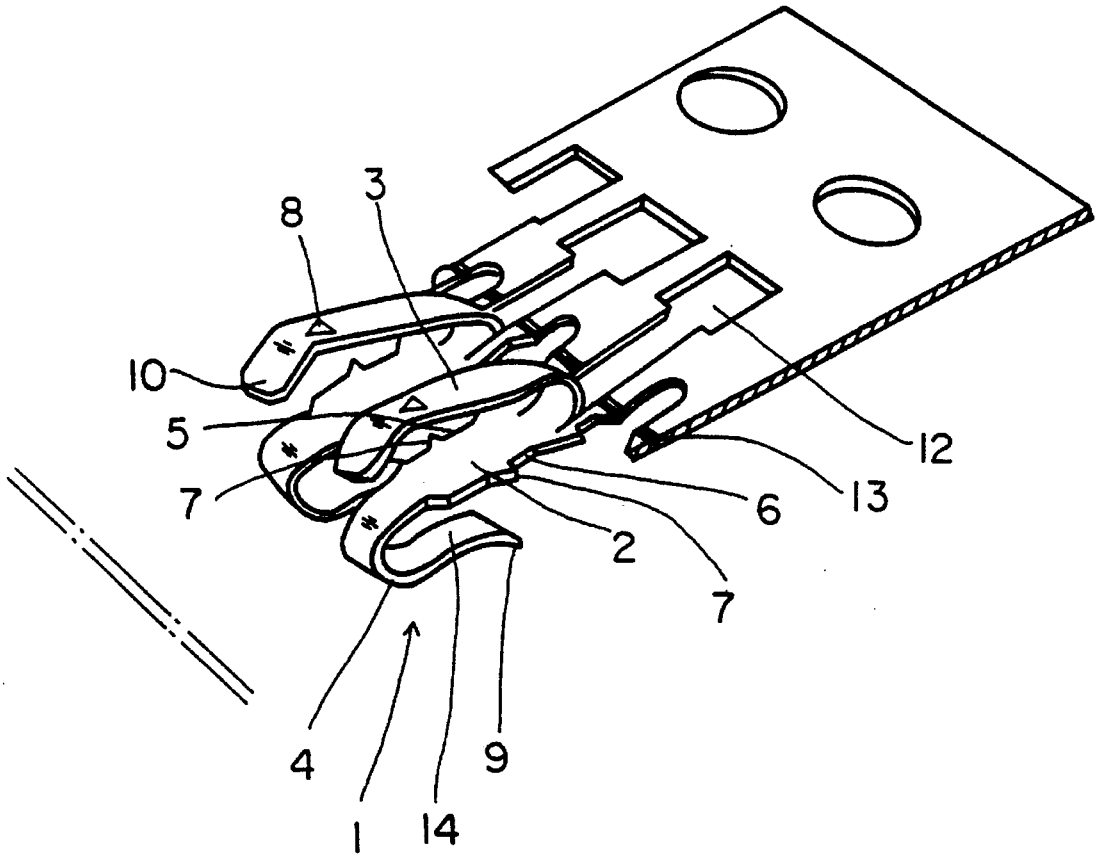
FIG. 13 is a perspective view of terminals integrally connected to a carrier strip.

Referring to FIG. 12, a first circuit element 35, such as a terminal lead, is inserted in the upper circuit element insertion opening 38. If the circuit element is inserted slightly off center it will contact inwardly converging wall 28 and be redirected into the upper contact beam cavities 36. The circuit element 35 will thereafter slide along the ceiling 23 between opposite portions 25 and 26 until it is sandwiched between the contact point 8 of the first contact beam 3 and the ceiling 23. This will make an electric connection between the circuit element 35 and the terminal 1 with good contact pressure provided by the terminal. Likewise, a second circuit element 34, such as an FFC is inserted into the lower circuit element insertion opening 39. If the circuit element is inserted slightly off center it will contact inwardly converging wall 29 and be redirected into lower contact beam cavity 37. The circuit element 34 will thereafter slide along floor 24 between opposite partitions 25 and 26 until it is sandwiched between the contact point 9 of the second contact beam 4 and the floor 24. This will make an electric connection between the circuit element 34 and the terminal 1 with good contact pressure provided by the terminal.

As may be understood from the above, two circuit elements can be inserted into selected cavities in the same surface of the receptacle. Also, a plurality of terminals can be inserted in the housing without fear of being caught and damaged, and therefore, an automatic terminal loading apparatus may be used. Finally, one beam of a terminal can form a generally non-disengagable contact point such as a wire trap while the other beam can form a disengagable contact point.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector for connecting a first circuit element to a second circuit element, the connector including, a housing (21) having a mounting end (19), a mating end (20) and first and second contact beam receiving cavities (36 and 37) in planes parallel to one another, and a generally S-shaped terminal (1) mounted in the housing (21) and defining a first and second cantilever beams (3, 4) disposed in the first and second cavities, respectively, with an intermediate base mounting section (2) between the contact beams, wherein the improvement comprises:

said intermediate base mounting section (2) located between and in a plane offset and generally parallel to said first and second contact beam-receiving cavities (36, 37), said first and second cavities having respective openings (38, 39) at the mating end (20) of the housing for receiving the first and second circuit elements (35, 34), respectively, from the same end of the housing, the first cantilever contact beam (3), extending directly from a first end of said base mounting section, in the first cavity (36) extending toward the respective opening (38) to a free end (10) of the beam and being adapted to apply a relative minimum withdrawal force on the first circuit element (35), and the second cantilever contact beam (4), extending directly from a second end of said base mounting section opposite said first end, in the second cavity (37) extending away from the respective opening (39) to a free end (14) of the beam and being adapted to apply a relative maximum withdrawal force on the second circuit element (34).

2. In an electrical connector as set forth in claim 1, wherein the first cantilever contact beam (3) has a rounded contact portion (8) spaced inwardly of the free end thereof for engaging the first circuit element (35).

3. In an electrical connector as set forth in claim 1, wherein said housing has an intermediate wall (22) separating said first and second contact beam receiving cavities (36, 37), said first cavity (36) defined by a ceiling (23), an upper surface of said intermediate wall (22), and opposite partition walls (25, 26), said second cavity (37) defined by a floor (24), a lower surface (40) of said intermediate wall (22), and opposite partition walls (25, 26), and the intermediate base mounting section (2) having lateral projections (7) on opposite sides adapted to skive into said opposite partition walls (25, 26) and a surface of said intermediate base mounting section adapted to lay on the lower surface (40) of the intermediate wall (22) whereby the terminal is held in the housing.

4. In an electrical connector as set forth in claim 1, wherein the free end (14) of the second cantilever contact beam (4) is constructed to be engageable with the second circuit element (34) at an acute angle to a direction of insertion of the circuit element (17) into the respective cavity (37).

5. In an electrical connector as set forth in claim 4, wherein the first cantilever contact beam (3) has a rounded contact portion (8) spaced inwardly of the free end (10) thereof for engaging the first circuit element (35).

* * * * *